US008362884B2

(12) United States Patent
Duge

(10) Patent No.: US 8,362,884 B2
(45) Date of Patent: Jan. 29, 2013

(54) RADIANT ELECTROMAGNETIC ENERGY MANAGEMENT

(75) Inventor: Robert T. Duge, Carmel, IN (US)

(73) Assignee: Rolls-Royce North American Technologies, Inc, Indianapolis, IN (US)

( * ) Notice: Subject to any disclaimer, the term of this patent is extended or adjusted under 35 U.S.C. 154(b) by 0 days.

(21) Appl. No.: 12/932,059

(22) Filed: Feb. 16, 2011

(65) Prior Publication Data

US 2011/0316678 A1 Dec. 29, 2011

Related U.S. Application Data

(63) Continuation of application No. 11/219,931, filed on Sep. 6, 2005.

(51) Int. Cl.
*H04B 3/36* (2006.01)
*B01J 19/12* (2006.01)
*B64D 1/04* (2006.01)

(52) U.S. Cl. ..... 340/407.1; 89/1.11; 89/1.13; 250/492.1

(58) Field of Classification Search ..... 250/504 R; 219/674; 340/573.4, 407.1; 89/1.11, 1.13
See application file for complete search history.

(56) References Cited

U.S. PATENT DOCUMENTS

| | | | | |
|---|---|---|---|---|
| 5,020,411 | A * | 6/1991 | Rowan | 89/1.11 |
| 5,675,103 | A * | 10/1997 | Herr | 89/1.11 |
| 5,936,183 | A * | 8/1999 | McNulty, Sr. | 89/1.11 |
| 7,400,487 | B1 * | 7/2008 | Bitar | 361/232 |
| 7,675,731 | B2 * | 3/2010 | Bitar | 361/232 |
| 2005/0156743 | A1 * | 7/2005 | Gallivan et al. | 340/573.4 |
| 2009/0059460 | A1 * | 3/2009 | Bitar | 361/232 |
| 2009/0128040 | A1 * | 5/2009 | Brown et al. | 315/5 |
| 2010/0226210 | A1 * | 9/2010 | Kordis et al. | 367/127 |

* cited by examiner

*Primary Examiner* — Nikita Wells
*Assistant Examiner* — Johnnie L Smith
(74) *Attorney, Agent, or Firm* — Krieg DeVault LLP

(57) ABSTRACT

A device provides a radiant electromagnetic energy output. During standby operation of the device, the output is provided at one or more frequencies selected to dissipate excess power through atmospheric absorption. Circuitry is included to tune the output of the device to a second frequency different than the first frequency for various directed energy applications that make use of the excess power. The circuitry can be arranged to further utilize frequency agility for power dissipation, to provide different operating modes involving a radiant output, or the like.

28 Claims, 6 Drawing Sheets

RADIANT ELECTROMAGNETIC ENERGY MANAGEMENT

CROSS-REFERENCE TO RELATED APPLICATION

The present application is a continuation of U.S. patent application Ser. No. 11/219,931 filed 6 Sep. 2005, which is incorporated herein by reference in its entirety.

BACKGROUND

The present application relates to the management of radiant electromagnetic energy, and more particularly, but not exclusively, relates to a frequency adjustable directed electromagnetic energy system.

Various High-Power Microwave (HPM) devices and other apparatus have been developed to provide directed energy weaponry. Frequently, this kind of weapon requires the generation of a significant amount of power to effectively impede an enemy; however, when the weapon is not being applied to a target, such power levels are typically not needed—and may even become problematic. Unfortunately, powering down between target applications often decreases the speed with which the weapon can be applied later, and may be unacceptably inefficient for a given type of power source. To address such shortcomings, one approach might be to employ a cooling jacket with a liquid medium to thermally dissipate excess power. Another approach may utilize energy storage devices, such as electrochemical batteries, to store excess power. Unfortunately, these approaches tend to add an undesirable amount of weight.

On another front, some directed energy weapons have been arranged to deliver a lethal emission, while others provide a nonlethal emission. A directed energy weapon that provides a ready option between lethal and nonlethal operation is also desired for some applications. Such an option may arise with or without the desire to better manage excess power.

Accordingly, there is a need for further contributions in this area of technology.

SUMMARY

One embodiment of the present invention is a unique technique for applying directed electromagnetic energy. Other embodiments relate to unique methods, systems, devices, and apparatus involving directed electromagnetic energy.

A further embodiment includes generating a radiant electromagnetic energy output with a radiant energy device, providing this output at a first frequency selected to dissipate excess power by atmospheric absorption of at least a portion of the output during operation of the device on standby, tuning the radiant electromagnetic energy output of the device to a second frequency different than the first frequency, and disabling a target by contact with the radiant electromagnetic energy output at the second frequency.

Another embodiment includes generating a radiant electromagnetic energy output with a directed energy weapon powered by a gas turbine, tuning this output to a first frequency for a first mode of weapon operation, and changing the output to a second frequency different than the first frequency for a second mode of weapon operation. In one form, the first mode corresponds to a power-on standby operating state of the weapon and the second mode corresponds to a target acquisition or target disabling state of the weapon. Optionally, for some embodiments, the target disabling mode may provide for selection between a lethal emission and a nonlethal emission.

Yet another embodiment is a system including a gas turbine engine, an electric power generator, and a radiant energy device powered by electricity from the generator. This device includes an input control and frequency control circuitry responsive to this input control to generate a radiant electromagnetic energy output with the device in a selected one of two or more operating modes. The control circuitry provides for the generation of the electromagnetic energy output at a first frequency during one of these modes to dissipate excess power through atmospheric absorption of at least a portion of such output, and at a second frequency during another of these modes to disable a target brought in contact with the radiant electromagnetic energy output.

Further embodiments, forms, objects, features, advantages, aspects, and benefits of the present invention shall become apparent from the detailed description and drawings included herein.

DETAILED DESCRIPTION

Figure 1:
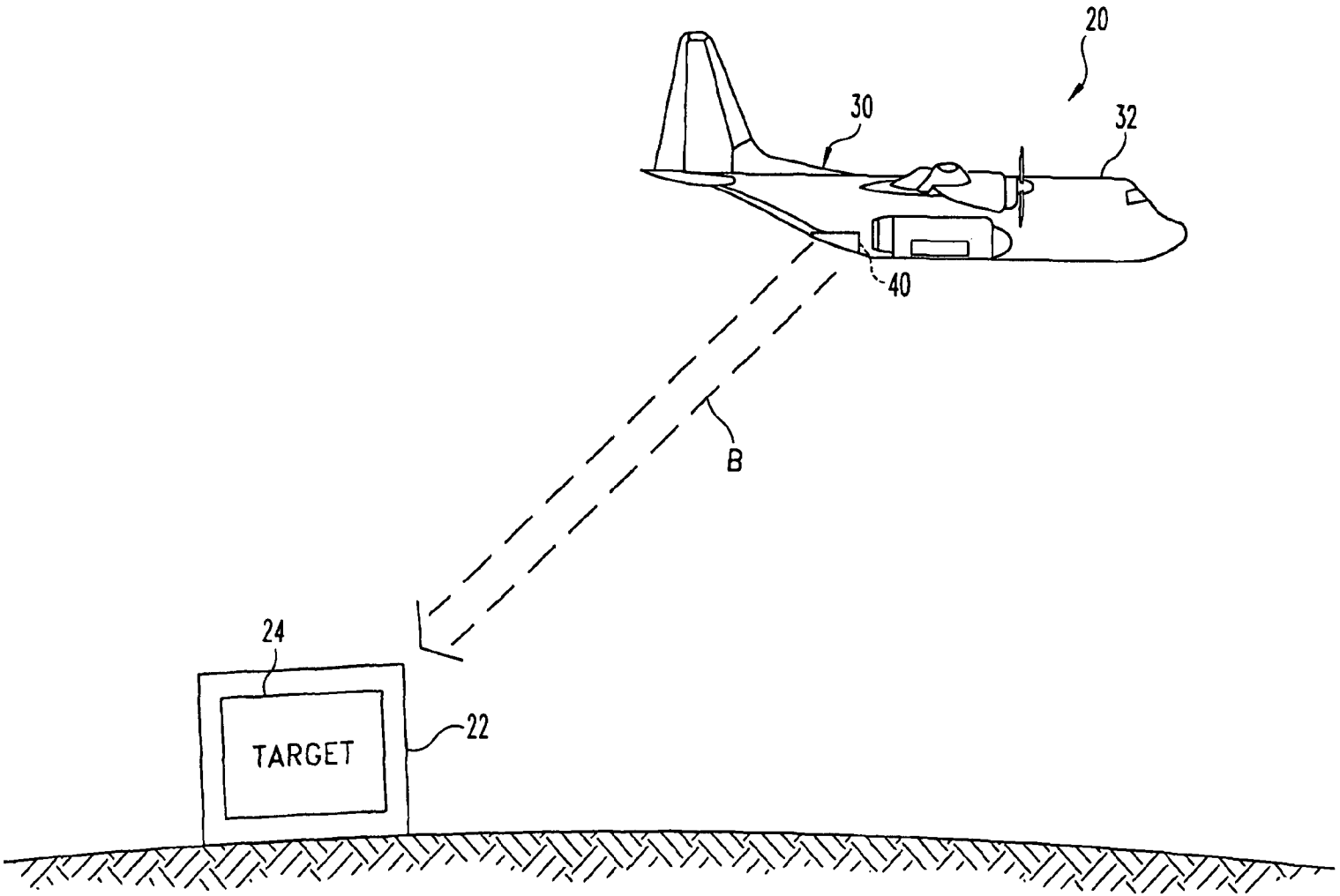
FIG. 1 is a partial diagrammatic view of one application of a radiant energy directing system.

While the present invention may be embodied in many different forms, for the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

FIG. 1 illustrates a radiant energy directing system 20 in an airborne application. System 20 includes an aircraft 30 directing a radiant electromagnetic energy beam B towards a targeted building 22. Beam B is generated with a radiant energy weapon 40 that is carried by aircraft 30. Building 22 encloses a weapon target 24. Beam B is ultimately directed to disable weapon target 24 by penetration through targeted building 22. Target 24 can be animate in nature (such as one or more enemy combatants, terrorists, or the like), inanimate (such as electronics equipment adversely effected by beam B), or a combination of these. Aircraft 30 can be alternatively designated as an airborne platform 32. The utilization of heavy power dissipation or energy storage equipment is often not practical for such airborne applications. Power dissipation, lethality of beam B, and other aspects regarding weapon 40 are described in connection with FIGS. 2-4 hereinafter.

Figure 2:
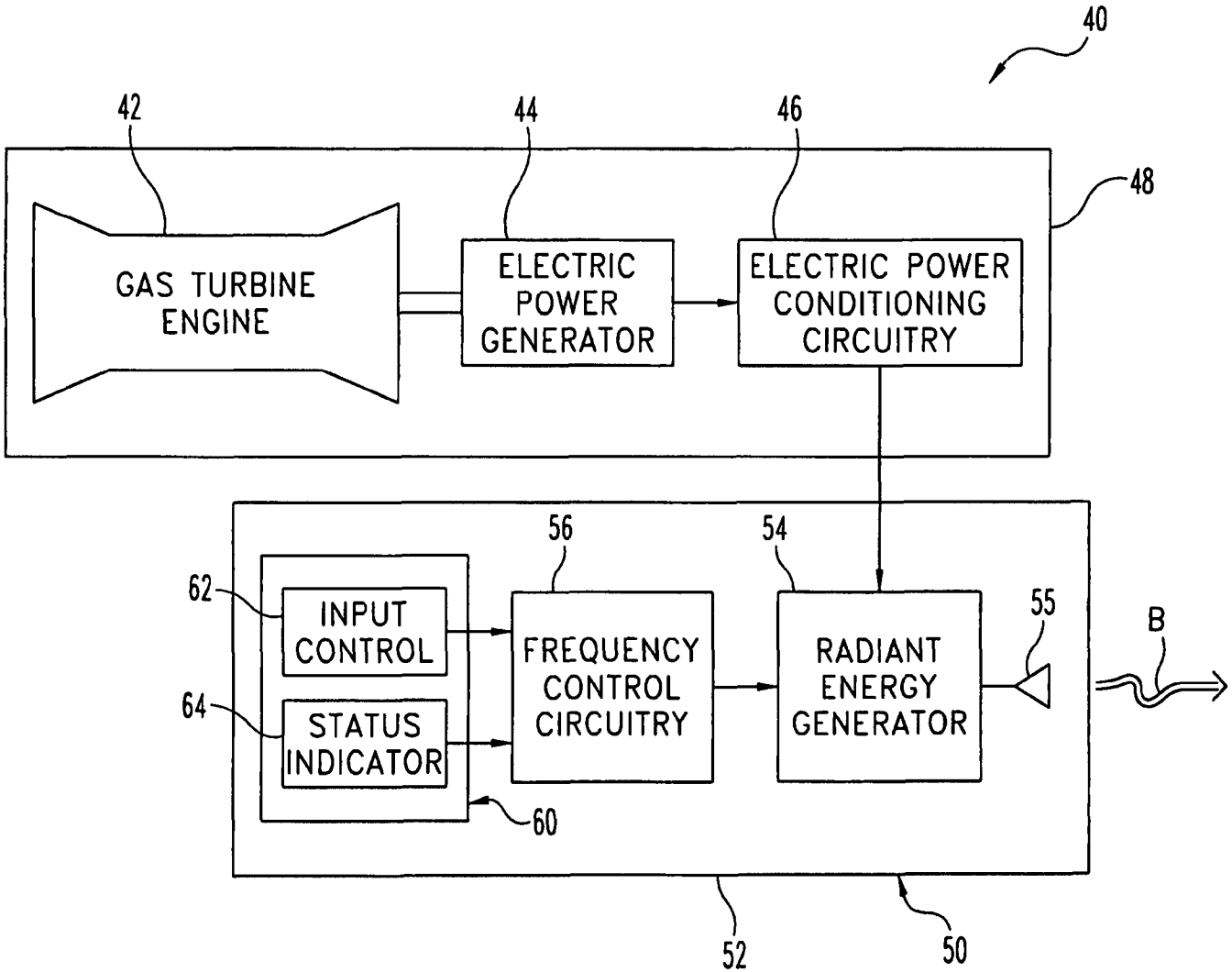
FIG. 2 is a diagram further detailing the system of FIG. 1.

Referring additionally to FIG. 2, weapon 40 includes a gas turbine engine 42 with a power shaft coupled to a generator 44. Such coupling may be direct, or through one or more belts, gears, cogs, mechanical power converters, clutches, or the like. Generator 44 converts rotational mechanical energy provided by gas turbine engine 42 to electricity, such that gas turbine engine 42 operates as the "prime mover" of generator 44. The electrical output of generator 44 is provided to electric power conditioning circuitry 46. Circuitry 46 converts the electrical input of generator 44 to a form suitable to generate radiant electromagnetic energy emissions of a desired type. Electrical output monitoring detection and feedback control (not shown) may be utilized to regulate the electricity provided by generator 44 through responsive adjustments to the operation of gas turbine engine 42, any associated mechanical linkage, generator 44, and/or circuitry 46. Collectively, gas turbine engine 42, generator 44, and circuitry 46 are designated as an electrical power source 48. It should be understood that other forms of a suitable electrical power source alternatively may be utilized in other embodiments. For example, a reciprocating piston type of internal combustion engine could be the prime mover for generator 44. In a further example, the alternative power source includes one or more energy storage devices for an application in which the weight contributed by such devices is acceptable. In another example, a nuclear reactor generates the requisite power, which is particularly suited to a marine or stationary platform. Yet other examples include different power source arrangements as would occur to those skilled in the art.

The conditioned electrical power output of source 48 is input to a radiant energy generating device 50, which can be further designated as directed energy weapon equipment 52. Device 50 includes a radiant electromagnetic energy generator 54. Generator 54 converts the electricity input from source 48 into a radiant electromagnetic energy output, such as beam B, that can be directed to target 24 (See FIG. 1). Depending on its particular configuration, generator 54 may include an antenna or other radiator 55 to provide this directed energy output. In one form, generator 54 is a form of gyrotron that generates a directed, radiant electromagnetic energy output in the microwave range. For some gyrotron applications, the conditioned electrical output of source 48 is provided in the 10 to 100 kilovolt range with power levels being in the megawatt range. In other forms generator 54 may be based on a form of laser, such as a free electron laser, that may extend from the microwave regime to the visible light spectrum; a combination of different radiant energy generators; and/or a different type of high-level electromagnetic energy generator suitable for the operations described herein.

Device 50 further includes frequency control circuitry 56 and operator Input/Output (I/O) devices 60. Devices 60 include an input control 62 and a status indicator 64. Input control 62 can be a manually operated control handled by a weapon operator, a computer-generated input, a sensor-based input, a combination of these, or a different arrangement as would occur to those skilled in the art. In one form, control 62 is responsive to target acquisition input of a type further described in connection with FIG. 3.

Frequency control circuitry 56 is responsive to control 62 to regulate frequency of the electromagnetic radiation energy output provided by generator 54, and correspondingly its wavelength, to provide different device operating modes. These operating modes are further described hereinafter in connection with FIGS. 3 and 4. Gyrotrons have been designed with frequency adjustability for plasma applications as discussed, for example, in O. Dumbrajs, *Tunable Gyrotrons for Plasma Heating and Diagnostics*, Computer Modeling and New Technologies, 1998, vol. 2, pp. 66-70; which is hereby incorporated by reference. In another non-limiting example, the frequency output of free electron lasers can be adjusted. Status indicator 64 provides a visual display indicating the operating mode of device 50, and other aspects relating to an indicated mode.

Figure 3:
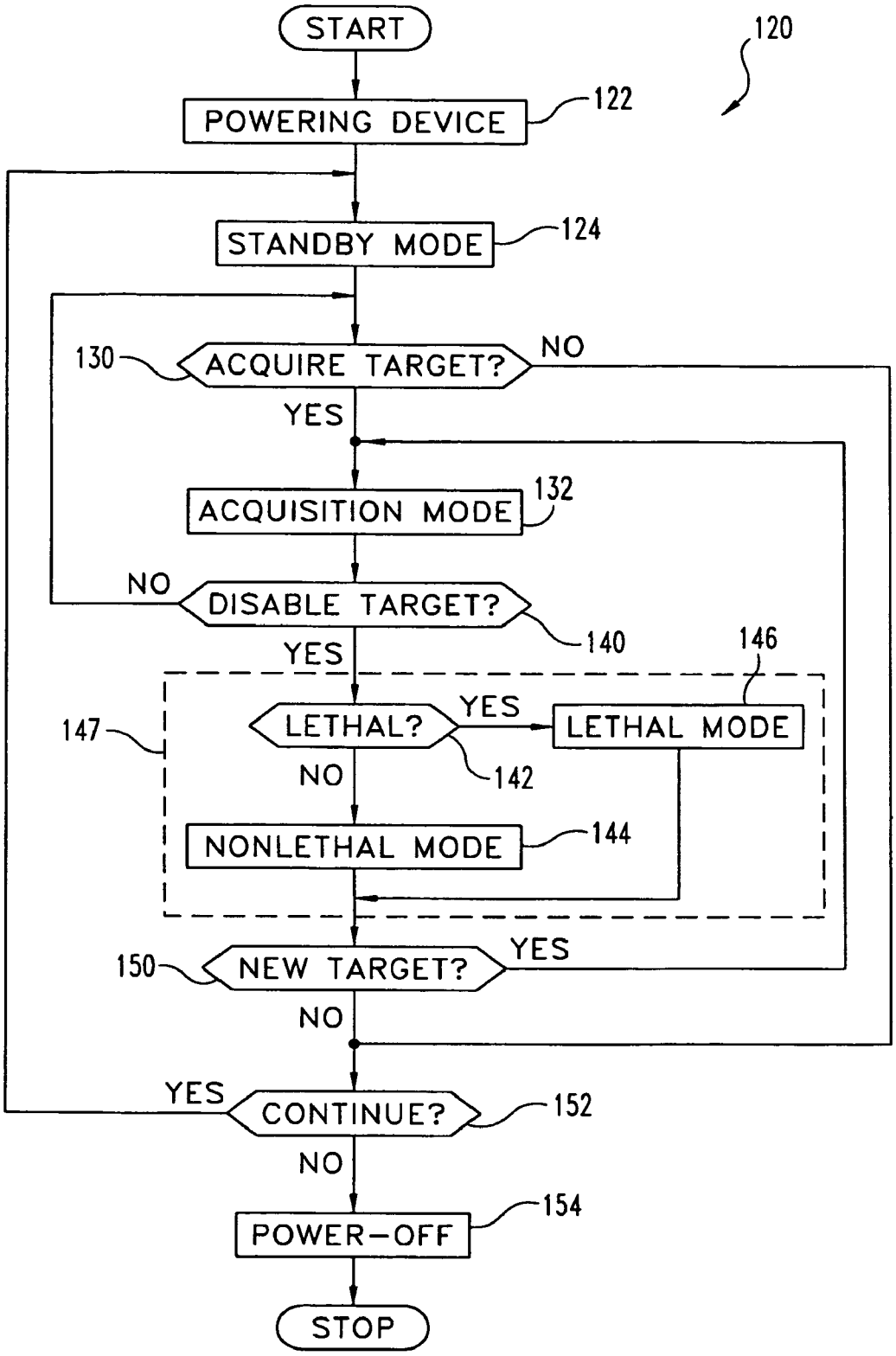
FIG. 3 is a flowchart illustrating various modes of operation of the system of FIG. 1.

FIG. 3 is a flow chart of a procedure directed to one mode of operating radiant energy directing system 20. This procedure is designated by reference numeral 120. Procedure 120 begins with initially powering on weapon 40 with electrical power source 48 in operation 122. Power-up could be in response to an input from control 62 and/or initiated in another manner. After initial power-on in operation 122, gas turbine engine 42 reaches a nominal, steady-state operating speed, generator 44 provides a corresponding electrical output to circuitry 46, and circuitry 46 provides conditioned electrical power to device 50. Device 50 starts and enters a standby mode in operation 124. During this power-on standby operating mode, the power generated by source 48 is sufficient to direct beam B of weapon 40 over a desired distance; however, no target (such as building 22 or target 24) has been identified or acquired yet. As a result, beam B is not being target-directed. Correspondingly, there is more power being generated by source 48 than device 50 needs. To manage this excess power during standby, the frequency of the radiant electromagnetic energy output by radiator 55 of device 50 is controlled to dissipate some, if not all, of the excess power through atmospheric absorption.

Figure 4:
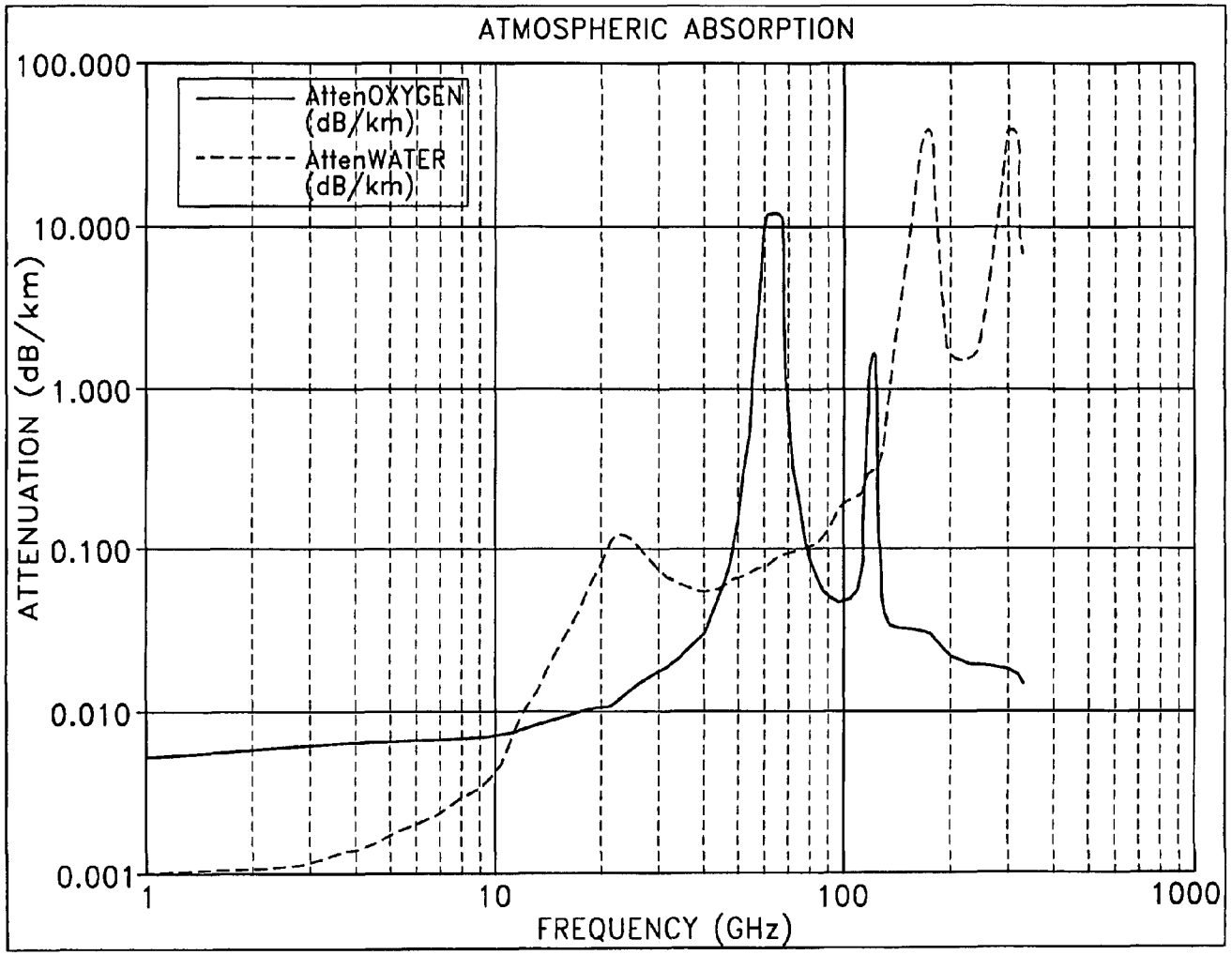
FIG. 4 is a graph of electromagnetic energy attenuation versus frequency for common atmospheric constituents.

Referring additionally to the graph of FIG. 4, electromagnetic radiation attenuation versus frequency is illustrated with respect to two common atmospheric constituents, oxygen and water. The solid line and broken line curves of this graph correspond to the absorption of electromagnetic radiation at various frequencies by oxygen and water, respectively. From FIG. 4, it should be noted that, for example, about 60 GigaHertz (GHz) corresponds to an absorption peak for oxygen, while about 180 GHz corresponds to an absorption peak for water. Frequency control circuitry 56 regulates operation of generator 54 so that the frequency of the radiated electromagnetic energy output is at one or more frequencies selected to dissipate excess energy through atmospheric absorption, such as 60 GHz, or the like; while device 50 performs in standby mode during operation 124. Alternatively, or additionally, the frequency agility of device 50 can be utilized to switch or "hop" among a number of different frequencies, at least some of which are selected for a corresponding absorption property of one or more atmospheric constituents to dissipate power. For this option, the output frequency is dithered, rapidly varying between multiple frequencies and scattering the output power over them to prevent any overheating or arcing that might result from saturation at any one particular frequency. One frequency-hopping pattern in terms of percentage (%) of time could be: 25% at 60 GHz, 10% at 55 GHz, 20% at 62 GHz, 10% at 25 GHz, 20% at 64 GHz, 5% at 22 GHz, and 10% at 65 GHz. Frequency control circuitry 56 can be designed to respond to input signals from control 62 to select between different types of standby operating modes in which one frequency or a combination of multiple frequencies is utilized to dissipate power.

Returning to the flow chart of FIG. 3, procedure 120 continues from operation 124 to conditional 130. Conditional 130 tests whether a target is to be acquired with weapon 40. If the test of conditional 130 is negative (false), procedure 120 continues with conditional 152. Conditional 152 tests whether to continue procedure 120 or not. If procedure 120 is not to continue then the negative (false) branch of conditional 152 proceeds to operation 154. In operation 154, device 50 is powered off and the generation of power with source 48 halts. If the test of conditional 152 is affirmative (true), then procedure 120 loops back to standby mode 124.

On the other hand, if the test of conditional 130 is affirmative (true)—that is acquisition of a target is commanded—then procedure 120 continues with operation 132. Operation 132 corresponds to an acquisition mode of device 50. Device 50 can be switched from the standby mode to the acquisition mode through input with control 62. In operation 132, device 50 locates a target through radar interrogation. Frequency control circuitry 56 adjusts operation of generator 54 during operation 132 to output a target interrogation frequency in the radar range, such as 94 GHz. For the purposes of target acquisition, device 50 and/or another device not shown, includes one or more detectors to sense a return radar signal as part of a standard interrogation process. It should be appreciated that more than one interrogation frequency could be utilized through appropriate control with circuitry 56. Additionally, or alternatively, acquisition mode performance during operation 132 can also include switching between one or more target interrogation/detection frequencies and one or more atmospheric absorption frequencies as described in connection with the standby mode of operation 124. In one example, circuitry 56 switches between 60 GHz and 94 GHz with a time-based distribution of about 95% and 5%, respectively. In another example, power-dissipating frequency hopping is utilized 98% of the time, with the remaining 2% directed to interrogation at 94 GHz or otherwise. In other embodiments, target acquisition can be performed by GPS subsystems, digital scene matching, Forward Looking Infra-Red (FLIR), laser "painting," or the like as an addition or alternative to radar acquisition.

After a desired target is acquired, such as weapon target 24 and/or targeted building 22 shown in FIG. 1, procedure 120 continues with conditional 140. Conditional 140 tests whether to activate weapon 40 to disable the acquired target. If the test of conditional 140 is negative (false), procedure 120 loops back to conditional 130 to determine whether to acquire a different target. Otherwise, if the test of conditional 140 is affirmative (true), procedure 120 proceeds with conditional 142. Conditional 142 tests whether the target should be disabled with weapon 40 in a lethal manner or not. If the test of conditional 142 is negative (false), then a nonlethal targeting mode in operation 144 is initiated. In this mode, weapon 40 is utilized to direct beam B to target 24 at a frequency selected with circuitry 56 that disables target 24, but without a high likelihood of being lethal. For example, for a human form of target 24, it has been found that an emission of electromagnetic energy at about 94 GHz can be incapacitating to a human target contacted by such emission at a sufficient intensity, while not resulting in death. Under appropriate conditions, such radiation can be directed a significant distance from airborne platform 32 to incapacitate a human form of target 24 even if target 24 is inside a conventional building, such as building 22. As a result, human targets can be disabled with weapon 40 without necessarily resulting in the destruction of structures enclosing such targets. Conditional 142 and operations 144 and 146 are grouped in the broken-line box to represent a target disabling mode 148.

If the test of conditional 142 is affirmative (true), then weapon 40 performs in a lethal mode in operation 146. During this lethal mode, circuitry 56 regulates the radiant electromagnetic energy output at a frequency selected to disable a target with a greater likelihood of termination than for the nonlethal mode of operation 144. In one nonlimiting example, a frequency of 2 GHz has been found to be suitable for lethal effect when contacting a human target with sufficient intensity.

From either operation 144 or 146, procedure 120 continues with conditional 150. In conditional 150, the desire to select a new target is tested. If this test is affirmative (true), procedure 120 returns to acquisition mode in operation 132 to acquire another target or reacquire the same target. If the test of conditional 150 is negative (false), then procedure 120 encounters conditional 152 which tests whether to continue procedure 120 or not. As previously described, if the test of conditional 152 is affirmative, procedure 120 returns to standby mode 124, and if the test of conditional 152 is negative, procedure 120 proceeds to operation 154 to power-down weapon 40, and then procedure 120 halts.

The various operating modes of weapon 40 such as the standby mode, target acquisition mode, target disabling mode, lethal mode, nonlethal mode, and the like, can each be reported via indicator 64 to an operator. Furthermore, selection among these various modes can be made through appropriate input with control 62 and/or through another input of a standard type. In one particular form, control 62 functions in cooperation with a processing device executing mission control logic that may provide for the switching between one or more modes automatically. In still other embodiments, one or more of these modes may be implemented differently or may be absent.

Figure 5:
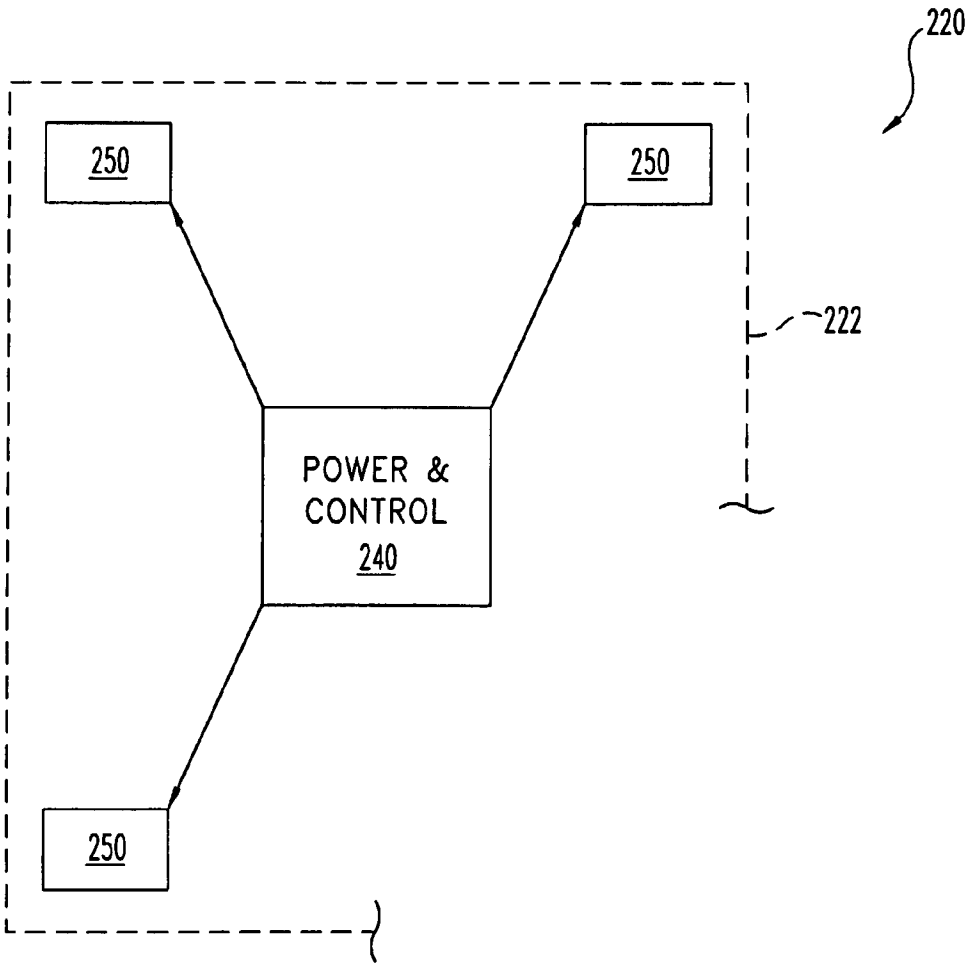
FIG. 5 is a partial diagrammatic view of another radiant energy device application.

Referring to FIG. 5, another form of a radiant electromagnetic energy system is shown in a partial diagrammatic form, as designated by reference numeral 220. System 220 is configured to utilize directed electromagnetic energy to protect a designated perimeter 222. System 220 includes a number of radiant energy generators 250 that are each the same as generator 54 as described in connection with system 20. In this instance, generators 250 are arranged to direct electromagnetic energy relative to perimeter 222 to provide protection from intruders. Generators 250 are collectively controlled by power and control circuitry 240. Circuitry 240 can include frequency control circuitry of the type described in connection with system 20, operator Input/Output (I/O) devices, and the like to monitor and regulate security of perimeter 222. In one arrangement, frequency is set to nonlethally disable intruders initially, and is selectively adjusted to a lethal mode during a persistent attack. In one implementation, the protected perimeter 222 is for a nuclear power plant and/or the power source for circuitry 240 is nuclear. In another implementation, perimeter 222 is defined by a number of vehicles each carrying a different generator 250. Yet other implementations include different arrangements as would occur to one skilled in the art.

Figure 6:
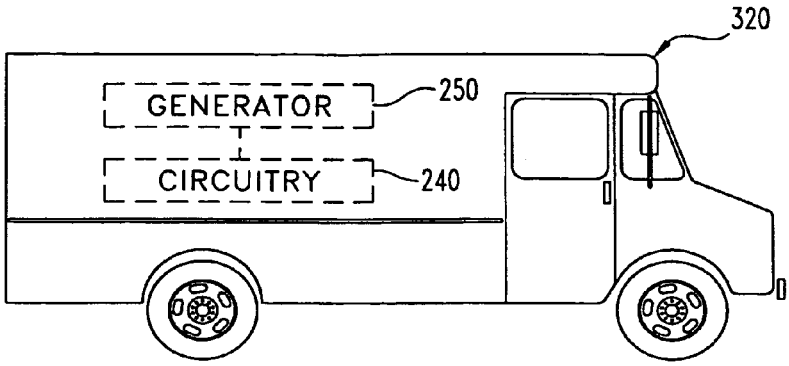
FIG. 6 is a diagrammatic view of a radiant energy device carried by a land-based vehicle.
Figure 7:
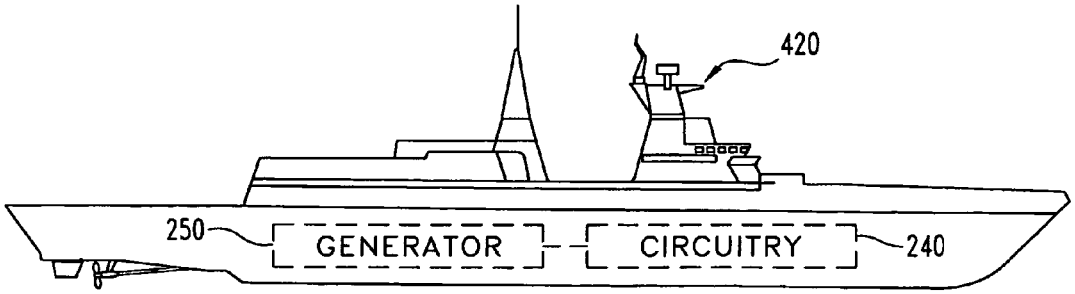
FIG. 7 is a diagrammatic view of a radiant energy device carried by a marine vehicle.

Many other embodiments of the present application are envisioned. For example, besides airborne platform 32, other forms of mobile directed energy devices could be utilized. For example, FIG. 6 diagrammatically illustrates a land-based, ground-engaging vehicle 320 carrying a generator 250 and circuitry 240; where like reference numerals refer to like features previously described. Another example is diagrammatically shown in FIG. 7 as a marine vehicle 420 (for example, a ship or submarine); where like reference numerals again refer to like features previously described. Marine vehicle 420 includes a generator 250 and circuitry 240. The vehicles 320 and 420 each can be structured to direct an energy beam B to disable a target as described in connection with the system 20 and the procedure 120; and/or can be structured to protect a perimeter as described in connection with the system 220. Still other implementations may be stationary or semi-stationary.

In a further example, directed radiant electromagnetic energy is utilized in a covert communication arrangement. This arrangement directs energy to a covert operative (a person) from a distance. The directed energy is selected and configured with respect to frequency, intensity, and/or modulation or the like, so that the operative readily feels such energy through skin contact (such as a heating or a tingling sensation), but is not incapacitated by it. Electromagnetic energy with a frequency of about 94 GHz is one nonlimiting example that is detectable by a human's nominal sense of touch and is not incapacitating when of a suitably low intensity. Correspondingly, the radiant emission of such energy is invisible to the unaided eye of an individual with nominal sensory perception. To communicate information, the energy is provided in a pattern recognized by the operative, such as Morse code to name one nonlimiting example.

Another example includes means for powering a radiant energy device to generate a radiant electromagnetic energy output with different modes of operation, means for providing the radiant electromagnetic energy output device at a first frequency to dissipate excess power, means for tuning the radiant electromagnetic energy output of the device to a second frequency different than the first, and means for disabling a target contacted by the output at the second frequency during a second mode of operation.

Yet another example includes: means for generating a radiant electromagnetic energy output with a radiant energy device, means for providing the radiant electromagnetic energy output of the device at a first frequency selected to dissipate excess power by atmospheric absorption of at least a portion of the radiant electromagnetic energy output during operation of the device on standby, means for tuning the radiant electromagnetic energy output of the device to a second frequency different than the first frequency, and means for disabling a target by contact with the radiant electromagnetic energy output at the second frequency.

Still another example comprises: means for generating a radiant electromagnetic energy output with a directed energy weapon powered by a gas turbine engine, means for tuning the electromagnetic energy output of the weapon to a first frequency for a first mode of weapon operation; and means for changing the electromagnetic energy output of the weapon to a second frequency different than the first frequency for a second mode of weapon operation.

A further example includes a gas turbine engine that operates as the prime mover for an electric power generator. The generator provides electricity to operate a directed energy weapon. This weapon provides a radiant electromagnetic energy output at a first frequency that is selected to dissipate excess power by atmospheric absorption of at least a portion thereof while the weapon operates in a power-on standby mode. Circuitry is included to tune the output of the weapon to a second frequency different than the first and disable a target by contact with the output at the second frequency. The circuitry can be arranged to provide further frequency agility to dissipate power, control lethality of the radiant output, or the like.

A different example includes: providing a radiant energy device to generate radiant electromagnetic energy that is detectable by sense of touch and is not visible with respect to nominal human sensory perception; modulating an output of the radiant electromagnetic energy with the radiant energy device to encode information therein; and covertly communicating the information to a person by the sense of touch by directing the output to make contact with skin of the person. In one form, the output has a frequency in a range from about 3 GHz through about 300 GHz.

Yet a further example is directed to an apparatus that includes a radiant energy device to generate radiant electromagnetic energy that is detectable by sense of touch and is not visible with respect to nominal human sensory perception. This device includes means for modulating an output of the radiant electromagnetic energy to encode information therein and means for covertly communicating the information to a person by the sense of touch by directing the output to make contact with skin of the person. In one form, the output has a frequency in a range from about 3 GHz through about 300 GHz.

Any theory, mechanism of operation, proof, or finding stated herein is meant to further enhance understanding of the present invention, and is not intended to limit the present invention in any way to such theory, mechanism of operation, proof, or finding. While the invention has been illustrated and described in detail in the drawings and foregoing description, the same is to be considered as illustrative and not restrictive in character, it being understood that only selected embodiments have been shown and described and that all equivalents, changes, and modifications that come within the spirit of the inventions as defined herein or by the following claims are desired to be protected.

What is claimed is:

1. A method, comprising:

generating a radiant electromagnetic energy output with a radiant energy device;

providing the radiant electromagnetic energy output of the device at a first frequency selected to dissipate excess power by atmospheric absorption of at least a portion of the radiant electromagnetic energy output during operation of the device on standby;

tuning the radiant electromagnetic energy output of the device to a second frequency different than the first frequency; and disabling a target by contact with the radiant electromagnetic energy output at the second frequency.

2. The method of claim 1, wherein the target is human and the disabling is configured to be lethal.

3. The method of claim 1, wherein the target is human, the disabling is configured to be nonlethal, and the device is arranged to provide a perimeter defense.

4. The method of claim 1, wherein the target is human, the disabling is configured to be lethal, and the device is arranged to provide a perimeter defense.

5. The method of claim 1, which includes changing the radiant electromagnetic energy output from the second frequency to a third frequency to change lethality of the disabling for a human form of the target.

6. The method of claim 1, wherein the radiant energy device is a form of directed energy weapon, the first frequency and the second frequency are each below 300 THz, and further comprising:

generating electricity with a gas turbine engine on an airborne platform;

powering the device with the electricity;

directing the radiant electromagnetic energy output to the target from the airborne platform carrying the weapon and the gas turbine engine; and acquiring the target with the radiant electromagnetic energy output tuned to a radar range frequency before performing the disabling.

7. The method of claim 1, wherein the radiant electromagnetic energy output is adjusted among a number of different frequencies including the first frequency while the device operates on standby.

8. The method of claim 1, which includes:

providing the radiant electromagnetic energy output at the first frequency and at a third frequency from the device; and controlling relative amounts of the radiant electromagnetic energy output at the first frequency and the third frequency to acquire the target during the operation of the device on standby.

9. The method of claim 1, wherein the radiant energy device is carried on land-based vehicle or a marine vehicle.

10. A method, comprising:

generating a radiant electromagnetic energy output with a directed energy weapon powered by a gas turbine engine;

tuning the electromagnetic energy output of the weapon to a first frequency for a first mode of weapon operation;

operating the weapon in a power-on standby condition during the first mode of weapon operation by selecting the first frequency to at least partially dissipate the electromagnetic energy output by the atmospheric absorption; and changing the electromagnetic energy output of the weapon to a second frequency different than the first frequency for a second mode of weapon operation.

11. The method of claim 10, which includes:

contacting a target with the electromagnetic energy output during the second mode of weapon operation to disable the target.

12. The method of claim 10, which includes:

acquiring a target during the first mode of weapon operation with the electromagnetic energy output; and contacting a target with the electromagnetic energy output during the second mode of weapon operation to disable the target.

13. The method of claim 12, which includes adjusting the electromagnetic energy output to a third frequency for a third mode of weapon operation, the third mode providing a more lethal form of disablement of the target by the electromagnetic energy output than the second mode.

14. The method of claim 10, wherein the first frequency and the second frequency are each in a range between 300 MHz and 300 THz, and further comprising:

generating electricity with the gas turbine engine;

powering the weapon with the electricity; and directing the electromagnetic energy output to the target from an airborne platform carrying the weapon and the gas turbine engine.

15. The method of claim 10, which includes adjusting the electromagnetic energy output among a number of different frequencies including the first frequency during a first mode of weapon operation.

16. The method of claim 10, which comprises during the first mode of weapon operation:

providing the electromagnetic energy output at the first frequency to dissipate power through atmospheric absorption and at a third frequency different than the first frequency; and controlling relative duration of the electromagnetic energy output at the first frequency and the third frequency during the first mode of weapon operation to acquire a target.

17. A system, comprising:

a gas turbine engine;

an electric power generator; and a radiant energy device powered by electricity from the generator, the device including an input control and frequency control circuitry coupled to the input control, the circuitry being responsive to the input control to generate a radiant electromagnetic energy output with the device in a selected one of two or more device operating modes, the control circuitry generating the electromagnetic energy output at a first frequency during a first one of the device operating modes to dissipate excess power through atmospheric absorption of at least a portion of the radiant electromagnetic energy output and at a second frequency for a second one of the device operating modes to disable a target brought in contact with the radiant electromagnetic energy output.

18. The system of claim 17, further comprising an aircraft carrying the gas turbine engine, the generator, and the device.

19. The system of claim 17, wherein the device further includes means for adjusting lethality of the radiant electromagnetic energy output for a human form of the target with the frequency control circuitry, and means for locating the target by radar interrogation with the frequency control circuitry.

20. The system of claim 17, wherein the device is a form of directed radiant energy weapon and further comprising an indicator to provide status of the weapon, and electric power conditioning circuitry coupled between the generator and the weapon.

21. The system of claim 17, further comprising means for applying the electromagnetic energy output during the second one of the device operation modes to provide protection for an established perimeter.

22. The system of claim 21, wherein the perimeter includes a national border.

23. The system of claim 17, further comprising one of a marine vehicle and a land-based vehicle carrying the gas turbine engine, the generator, and the device.

24. Apparatus, comprising:

means for powering a radiant energy device to generate a radiant electromagnetic energy output with different modes of operation;

means for providing the radiant electromagnetic energy output of the device at a first frequency to dissipate excess power by atmospheric absorption of at least a portion of the radiant electromagnetic energy output during a first mode of operation;

means for tuning the radiant electromagnetic energy output of the device to a second frequency different than the first frequency; and means for disabling a target contacted by the radiant electromagnetic energy output at the second frequency during a second mode of operation.

25. A method, comprising:

providing a radiant energy device to generate radiant electromagnetic energy that is detectable by sense of touch and is not visible with respect to nominal human sensory perception;

modulating an output of the radiant electromagnetic energy with the radiant energy device to encode information therein; and covertly communicating the information to a person by the sense of touch by directing the output to make contact with skin of the person.

26. The method of claim 25, wherein the modulating of the output includes intermittently transmitting the radiant electromagnetic energy in accordance with a pattern to encode the information.

27. The method of claim 25, wherein the radiant electromagnetic energy has a frequency in a range from about 3 GHz through about 300 GHz.

28. The method of claim 25, wherein the radiant energy device is carried on an airborne platform.

* * * * *